US005657519A

United States Patent [19]

Smith

[11] Patent Number: 5,657,519

[45] Date of Patent: Aug. 19, 1997

[54] SAFETY PIN WITH DETACHABLE CAP

[76] Inventor: Susan A. Smith, 871 Dana, Valley Stream, N.Y. 11580

[21] Appl. No.: 563,373

[22] Filed: Nov. 28, 1995

[51] Int. Cl.[6] ..... A44B 9/00

[52] U.S. Cl. ..... 24/710.2; 24/706.5; 24/708.7; 24/711.4

[58] Field of Search ..... 24/710.2, 706.1, 24/706.5, 707.9, 711.4, 711.5, 708.7, 116 A, 709.1, 710

[56] References Cited

U.S. PATENT DOCUMENTS

| | | | |
|---|---|---|---|
| 354,830 | 12/1886 | Freeman | 24/709.1 |
| 660,052 | 10/1900 | Diggs | 24/711.4 |
| 663,063 | 12/1900 | Clausen | 24/711.4 |
| 904,751 | 11/1908 | Bernthold | 24/711.4 |
| 959,472 | 5/1910 | Dancy et al. | 24/708.7 |
| 967,924 | 8/1910 | Irwin | 24/706.5 |
| 1,360,794 | 11/1920 | Ralph | 24/708.7 |
| 1,410,770 | 3/1922 | Silverman et al. | 24/116 A |
| 2,526,818 | 10/1950 | Hartley | 24/708.7 |
| 2,869,206 | 1/1959 | Yeglinski | 24/710 |
| 3,225,565 | 12/1965 | Bohlinger et al. | 24/116 A |
| 3,806,997 | 4/1974 | Niwa . | |
| 4,030,166 | 6/1977 | Betters . | |
| 4,044,429 | 8/1977 | Wagner . | |
| 4,412,368 | 11/1983 | Springer . | |
| 4,773,130 | 9/1988 | Millar et al. . | |

OTHER PUBLICATIONS

Frantz, Delores, *Safety Pin Beading*, 1994.

*Primary Examiner*—Victor N. Sakran
*Attorney, Agent, or Firm*—Lieberman & Brandsdorfer, LLC

[57] ABSTRACT

A pin for decorating items comprising a plurality of limbs and a detachable cap. The pin comprises a first limb and a second limb. Each of the limbs comprises a distal end and a proximal end. A distal end of the first limb is attached to a distal end of the second limb. The proximal end of the first limb is removably secured to the cap independently of the second limb, and a proximal end of the second limb is removably secured to the cap independently of the first limb. At such time as the first and second limbs are both detached from the cap, decorative items and accessories may be threaded onto or removed from the first or second limbs. Following the threading of the accessories, both the first and second limbs may be independently reattached to the cap.

18 Claims, 4 Drawing Sheets

SAFETY PIN WITH DETACHABLE CAP

TECHNICAL FIELD OF THE INVENTION

The present invention relates to a safety pin with a detachable head or cap.

BACKGROUND OF THE INVENTION

This invention relates to safety pins, and, in particular, to safety pins of the well-known type capable of being moved between open and closed states. These safety pins comprise a first wire limb or back shank and a second wire limb or front shank, the first wire limb having a cap at one end and being connected at the other end through an integral loop or coil to the second wire limb. An end portion of the second wire limb remote from the connection with the first wire limb is releasably engaged with the cap when the pin is in its closed state and free from the cap when the pin is in its open state. The remote end portion of the second wire limb, when engaged with the cap, is disposed and retained in a recess in the cap opening towards the first wire limb.

Safety pins of the conventional type described above have become a staple of the hobby and craft industry. Typically, these safety pins are decorated by placing ornamental beads or other decorative items on the second wire limb. These pins are then worn or otherwise displayed as decorative accessories.

One problem with using conventional safety pins is that when they are removed there is the ever present problem of the beads or other decorative items falling off the free end of the second wire limb and becoming lost or damaged. A second problem with using safety pins of the conventional type for hobby and craft work is that the only way to alleviate the first problem is to somehow permanently affix the items to the pin. However, it is often desirable to change the design or look of a decorated pin. Where the decorative items are permanently attached to the safety pin, this is clearly impossible.

Alternatively, the safety pins can be decorated by prying open the loop or coil connecting the first and second wire limbs and threading the beads or other decorative items down the second wire limb and forcing them around the coil and onto the first wire limb. While pins decorated in this manner do not suffer from the problems described above, they have their own problems. These include the inability to use items or beads beyond a certain size depending on the size of the safety pin used, damage to beads or other decorative items when forcing them around the loop and the inability to quickly and easily remove the decorative beads or other decorative items.

SUMMARY OF THE INVENTION

It is therefore the general object present invention to provide a pin having a plurality of limbs and a detachable cap wherein each of the limbs are separately and removably attached to the cap.

Another object of the invention is to provide a pin having a plurality of limbs and a detachable cap wherein a first limb of the pin is attached to the detachable cap by means of a standard recess embedded into the cap. A second limb comprises a threaded connector at the first end for being securely and removably attached to a threaded receiving means of the cap.

It is a further object of the invention to provide a pin having a plurality of limbs and a detachable cap, wherein a first limb of the pin is attached to the detachable caps by means of a standard recess embedded into the cap. A second limb comprises a spring mechanism for removably securing the second limb to the cap.

Furthermore, it is a further object of the invention to provide a method of making jewelry and other decorative accessories comprising the steps of removing a plurality of limbs of a pin from a cap, attaching decorative items to one or both of the limbs, and separately reattaching both of the limbs to the cap.

In accordance with the invention, these and other objectives are achieved by providing a pin comprising a first limb and a second limb, and a means for removably securing both the first and second limbs to a cap, as well as a means for carefully removing both the first and second limbs from the cap. At such time as one or both of said limbs are removed from the cap, decorative items may be threaded onto one or both of said limbs, after which both limbs are reattached and secured to the cap.

BRIEF DESCRIPTION OF THE DRAWINGS

The present invention may be more readily understood by reference to the following drawings (wherein like numbers refer to like parts) in conjunction with the description provided herein. The drawings are provided for illustrative purposes only and are not intended to limit the scope of the invention in any way.

DETAILED DESCRIPTION

All of the problems associated with conventional safety pins are rendered moot by the present invention: a safety pin with a detachable head or cap at the end of the first wire limb remote from the connection with the Second wire limb. With the present invention, decorative beads or other items can be threaded onto the first wire limb after removing the cap and temporarily fixed there by reattaching the cap.

Figure 1:
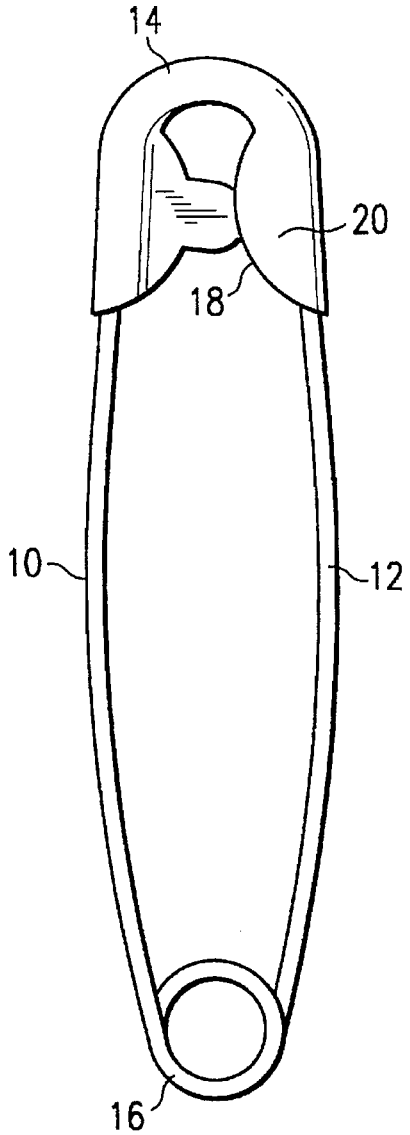
FIG. 1 (PRIOR ART)
FIG. 1 is an illustration of a conventional safety pin.
Figure 2:
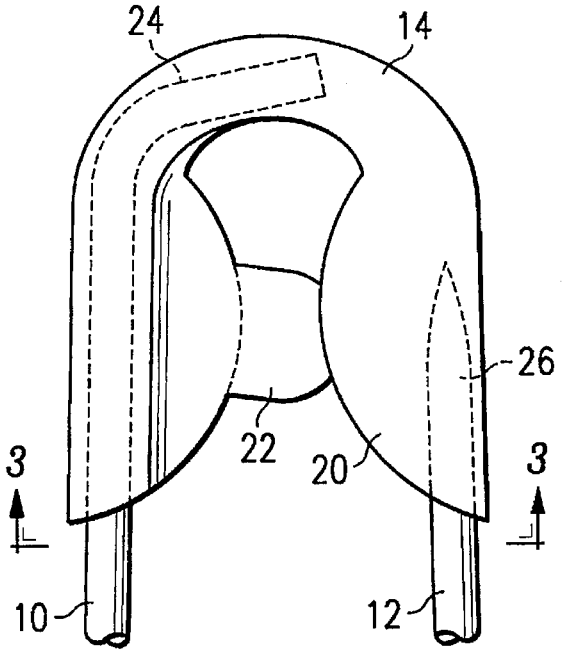
FIG. 2 (PRIOR ART)
FIG. 2 is an illustration of the cap of a conventional safety pin and the manner in which it is permanently attached to the remainder of the safety pin.
Figure 3:
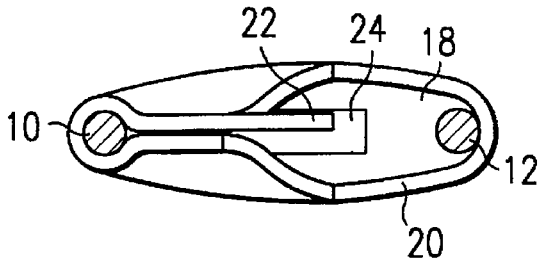
FIG. 3 (PRIOR ART)
FIG. 3 section on the line 3—3 of FIG. 2.

The safety pin shown in FIGS. 1, 2 and 3 comprises a length of resilient wire bent to form a first limb 10 and a second limb 12, the limbs being spaced apart and approximately parallel with each other. The first limb 10 has a cap 14 at one end and is connected at the other end to the second limb 12 through the intermediary of a spring coil 16 integral with the limbs. An end portion 26 of the second limb 12 remote from the coil 16 is shaped to form a point and is releasably engageable with the cap 14. The pin is shown in its closed state, in which the end portion 26 of the second limb 12 is disposed in a recess 18 in the cap 14 defined by spaced wings 20, the recess 18 opening towards the first limb 10. The pin can also take up an open state (not shown) in which the end portion 26 of the second limb 12 is released from the recess 18, and the second limb 12 is urged by the coil 16 to a position somewhat further away from the first limb 10. The arrangement is such that the pin can be moved from its open state to its closed state first by movement of the second limb 12 towards the first limb 10 so that the end portion 26 of the second limb 12 lies to one or the other side of the cap 14 as desired, then by movement of the second limb so that the end portion 26 abuts a tongue 22 on the cap which tongue projects towards the recess 18 from a part of the cap 14 facing the recess 18, and finally by release of the first limb 10 so that the end portion 26 of the second limb 12 moves into the recess 18 owing to the resilience of the spring coil 16, the end portion 26 being guided into the recess by the tongue 22.

Referring now to FIG. 2, in a conventional safety pin, the cap 14 is irremovably attached to an end portion 24 of the first limb 10 which extends into the cap 14 and is bent relative to the remainder of the first limb 10 to serve as an anchor for the cap 14. The cap 14 is simply formed around or otherwise permanently attached to the end portion 24 of the first limb 10 retained within the cap 14.

Figure 4:
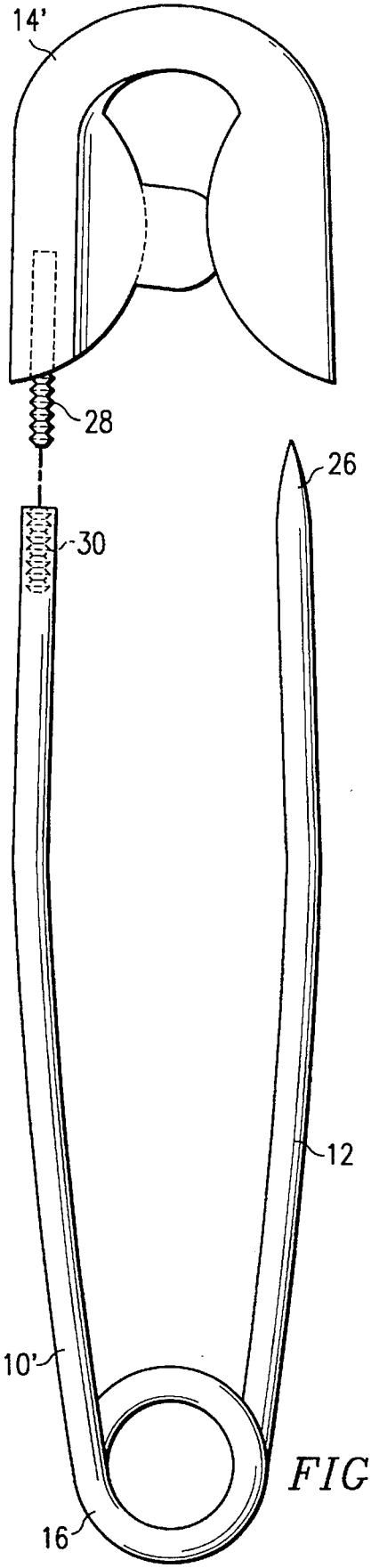
FIGS. 4 and 5 are illustrations of a safety pin with a removably attachable cap wherein the cap is attached using threaded connector.
Figure 5:
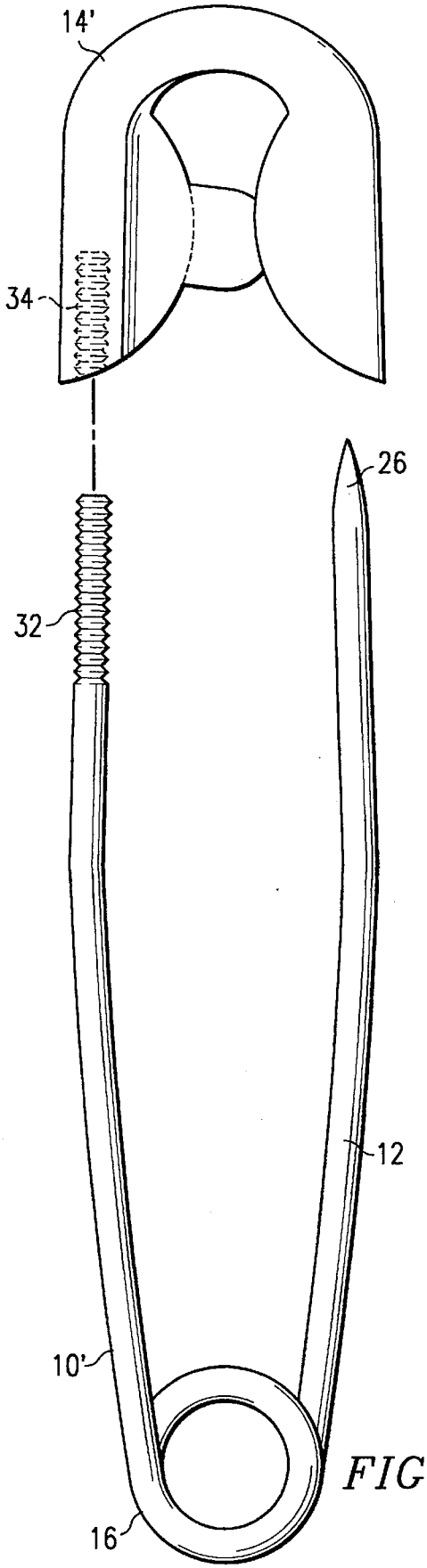

In the present invention on the other hand, the cap 14' is removably attached to the first limb 10'. Preferably, the cap 14' is removably attached to the first limb 10' using a nut and bolt like arrangement, i.e., a threaded connector. In one embodiment shown in FIG. 4, there is a threaded rod 28 extending from the cap 14' opposite the recess 18 and coaxial with the first limb 10' The end of the first limb 10' remote from the coil 16, in turn, has a threaded receptacle 30 into which the threaded rod 28 is screwed. In another embodiment, shown in FIG. 5, the end of the first limb 10' remote from the coil 16 is provided with threads 32 such that the cap 14' can be screwed on by means of threaded receptacle 34 provided within the cap 14' opposite the recess 18.

Alternatively, the cap 14' can be removably attached to the first limb 10' by any of the clasps, closures or locking mechanisms conventionally used in the field of jewelry and accessories for removably attaching decorative items. For example, in a number of alternative embodiments illustrated in FIGS. 6, 7 and 8, the first limb 10' is provided with either a ramped annular groove 36 (FIG. 9*a*) or an unramped annular groove 38 (FIG. 9*d*) near the end remote from the coil 16 rather than with threads 32 or a threaded receptacle 30. Alternatively, the first limb 10' can be provided with a pair of oppositely disposed unramped recesses 40 (FIG. 9*c*) or ramped recesses 42 (FIG. 9*b*). The cap 14' is attached by means of a spring or spring-like mechanism which removably inserts into the annular groove 36, 38 or the oppositely disposed recesses 40, 42.

Figure 6:
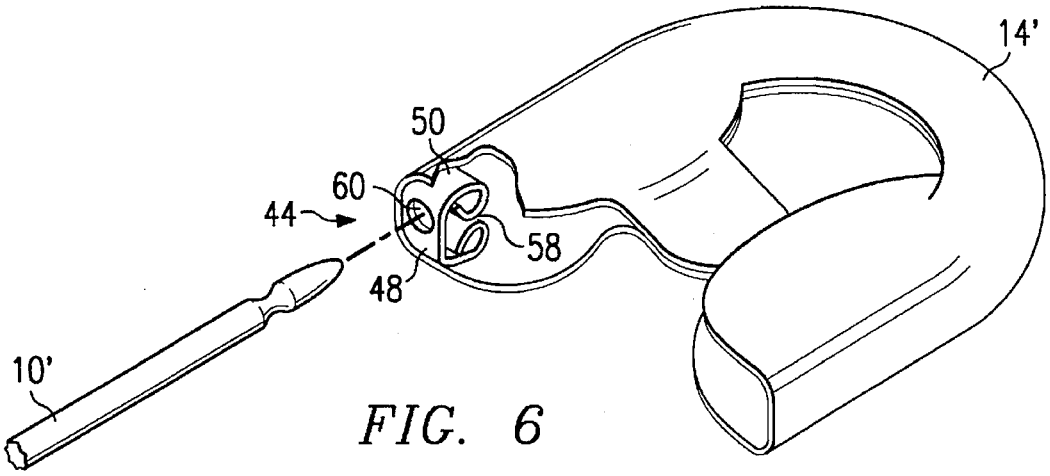
FIG. 6 is an illustration of a safety pin with a detachable cap wherein the cap is snapped on using a butterfly shaped or coiled spring mechanism.
Figure 7:
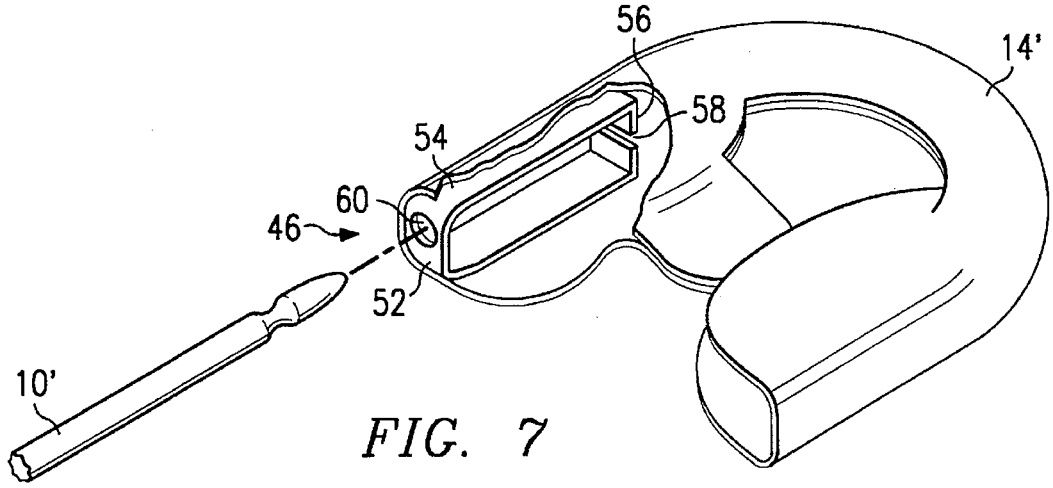
FIG. 7 is an illustration of a safety pin with a detachable cap wherein the cap is attached using a U-shaped spring.

The spring or spring-like mechanism can be the well-known coiled or butterfly shaped spring 44 as shown in FIG. 6 or a generally U-shaped spring 46 as shown in FIG. 7. The coiled or butterfly shaped spring 44 has a generally flat base 48 integrally connected to a pair of oppositely facing closed coil extensions 50 extending from either side of the flat base 48.

The U-shaped spring has a generally flat base 52 integrally connected to a pair of oppositely facing L-shaped extensions 54 extending from either side of the flat base 52 which form the sides of the U. The L-shaped extensions 54 are sufficiently long to allow the ends of the L-shaped extensions 56 to flex outwardly. The distance 58 between the closed coil extensions 50 or the L-shaped extensions 54 is less than the diameter of the first limb 10' The cap 14' is attached by means of an opening 60 centrally located in the flat base 48, 52 into which the end of the first limb 10' remote from the coil 16 is inserted. In this manner, the cap 14' can be removably snapped into place or detached by simply applying sufficient tension between the cap 14' and the first limb 10' to deform the spring-like mechanism 44, 46 to such an extent that the first limb 10' can be withdrawn or inserted therebetween. The cap 14' is held in place by the closed coil extensions 50 or L-shaped extensions 54 which removably insert into the groove 36, 38 or the oppositely disposed recesses 40, 42. This is facilitated by providing tapered end 62 (FIGS. 9*a*–9*d*) as the end of the first limb 10' remote from the connection with second limb 12. As the first limb 10' is inserted into the spring like mechanism 44, 46, the tapered end 60 gradually widens the opening 58 until the groove 36, 38 or oppositely disposed recesses 40, 42 are reached, at which time the opening 58 is at its greatest. As the first limb 10' is further inserted, the closed coil extensions 50 or the L-shaped extensions 54 snap into the groove 36, 38 or the oppositely disposed recesses 40, 42 to hold the cap 14' on first limb 10'. To remove the cap, the process is simply reversed.

Figure 8:
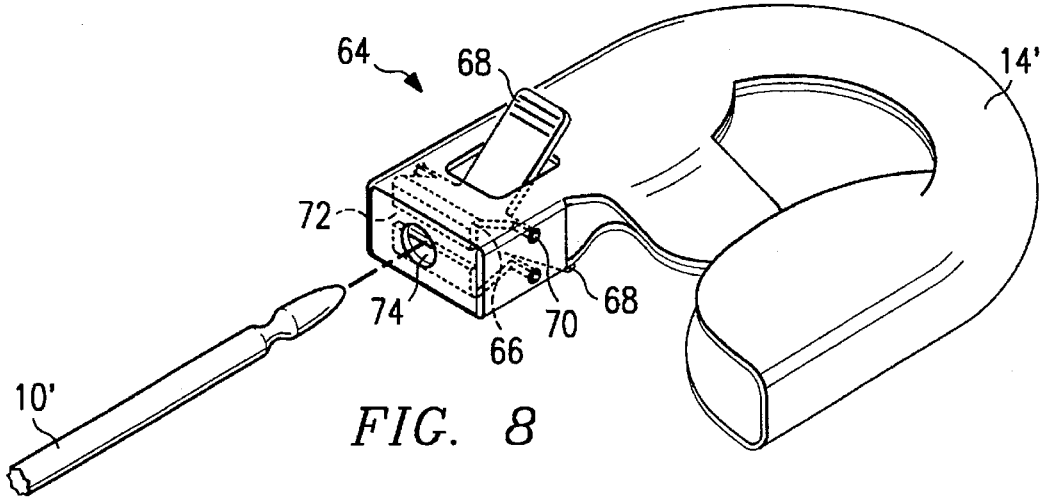
FIG. 8 is an illustration of a safety pin with a detachable cap wherein the cap is attached using a spring biased clamp.
Figure 9A:
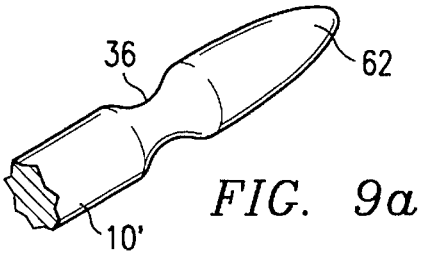
FIGS. 9*a*, 9*b*, 9*c* and 9*d* are illustrations of the first wire limb of a safety pin with a detachable cap showing the grooves or oppositely disposed recesses near the end of the first wire limb remote from the connection with the second wire limb that are used in conjunction with the spring mechanisms described herein to removably attach the cap.
Figure 9B:
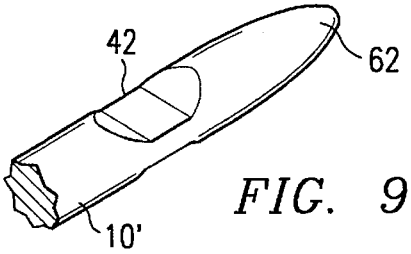
Figure 9C:
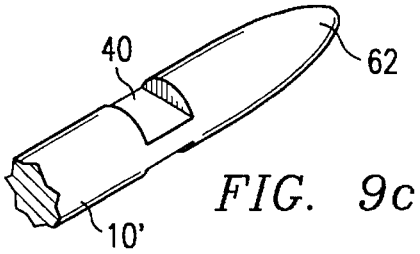
Figure 9D:
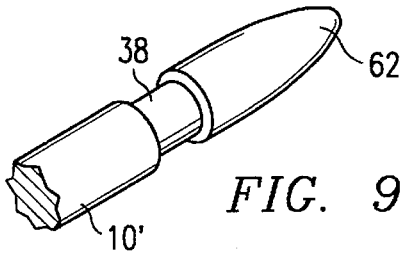

In another embodiment, illustrated in FIG. 8, the cap 14' is provided with a closed end having an opening 74 and is removably attached using a spring biased clamp 64 which removably inserts into the annular groove 36, 38 or a pair of oppositely disposed recesses 40, 42. The spring biased clamp 64 has a pair of generally V-shaped clamp ends 66 integrally connected and operatively associated with wings or tabs 68. Each of the clamp end 66/tab 68 components is pivotally mounted on pin 70 to provide for an opening 72 between the clamp ends 66 of less than the diameter of first limb 10'. Insertion and withdrawal of the first limb 10' is accomplished by first squeezing the tabs 68 together such that the opening 72 between the clamp ends 66 is increased. The first limb 10' is then inserted through opening 74 and the tabs 68, which are biased apart by a spring (not shown), are released to allow the clamp ends 66 to move into the groove 36, 38 or the oppositely disposed recesses 40, 42 to hold the cap 14' in place. To remove the cap 14', the tabs 68 are again squeezed together allowing the first limb 10' to be withdrawn. While the spring biased clamp 64 preferably is as described above, it is to be understood that any configuration or shape is acceptable so long as that when the tabs 68 are squeezed together the clamp ends 66 move apart to allow the insertion or withdrawal of the first limb 10'. To remove the head, pressure is exerted against wings or tabs 68 causing the clamp ends 66 to withdraw from the annular groove 36, 38 or the oppositely disposed recesses 40, 42 to such an extent that the first limb 10' can be withdrawn from the cap 14'.

The design and manufacture of the above-described embodiments and as well as the incorporation of other clasps, closures, and locking mechanisms utilized in the jewelry and accessories fields into the cap 14' and/or first limb 10' of a safety pin are well within the ordinary skill of one in the art.

Figure 10:
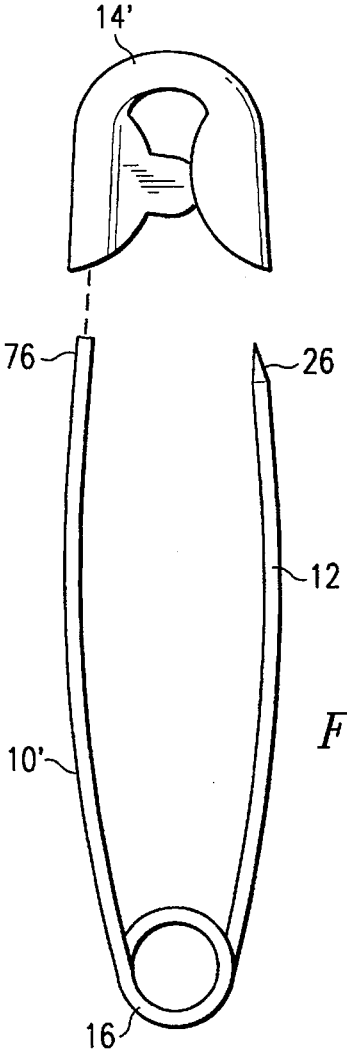
FIG. 10 is an illustration of a safety pin with a detached cap wherein the cap can be irremovably attached using, e.g., glue.

In yet another embodiment, illustrated in FIG. 10, the end 76 of the first limb 10' remote from the connection with the second limb 12 is unaltered, i.e., identical to the remainder of the first limb 10'. The cap 14' is removably attached to the first limb 10' by applying a glue or other adhesive to either the end of the first limb 10' remote from the connection with the second limb 12 or to the inner portion of the cap 14' opposite recess 18 and inserting the first limb 10' into the cap 14'.

What is claimed is:

1. A pin comprising:

a first limb having a proximal end and a distal end;

a second limb having a proximal end and a distal end;

a detachable cap;

said proximal end of said first limb being removably attached to said cap;

said distal end of said first limb being remote from said proximal end and being connected to said distal end of said second limb;

said proximal end of said second limb being releasably engagable with said cap; and wherein said proximal end of said first limb comprising a threaded connector for being received by a threaded receiving means of said cap.

2. The pin of claim 1, wherein the distal ends of the first and second limbs being connected by a coil means integral with the first and second limbs.

3. The pin of claim 1, wherein said pin being a safety pin.

4. A pin comprising:

a first limb having a proximal end and a distal end;

a second limb having a proximal end and a distal end;

a detachable cap;

said proximal end of said first limb being removably attached to said cap;

said distal end of said first limb being remote from said proximal end and being connected to said distal end of said second limb;

said proximal end of said second limb being releasably engagable with said cap; and wherein said proximal end of said first limb comprising a pair of oppositely disposed recesses and said cap being attached to said proximal end of said first limb by means of a spring mechanism.

5. The pin of claim 4, wherein said spring mechanism resiliently engaging said oppositely disposed recesses of said first limb.

6. The pin of claim 5, wherein said pin being a safety pin.

7. The pin of claim 4, wherein said first limb further comprising an annular groove near said proximal end of said first limb for being received by said spring mechanism.

8. The pin of claim 7, wherein said spring mechanism comprising a coiled spring.

9. The pin of claim 7, wherein said spring mechanism comprising a U-shaped spring.

10. The pin of claim 4, wherein said detachable cap being attached to the first limb by means of a spring-biased clamp comprising clamp ends operatively associated with tabs for effecting their displacement.

11. The pin of claim 10, wherein said clamp ends removably insert into said annular groove of said first limb.

12. The pin of claim 11, wherein said first limb further comprises a pair of oppositely disposed recesses near said proximal end of said first limb, and wherein said clamp ends removably insert into said oppositely disposed recesses.

13. The pin of claim 4, wherein said spring mechanism comprising a coiled spring.

14. The pin of claim 4, wherein said spring mechanism comprising a U-shaped spring.

15. A pin comprising:

a first limb having a proximal end and a distal end;

a second limb having a proximal end and a distal end;

a detachable cap;

said proximal end of said first limb being irremovably attached to said cap by means of an adhesive;

said distal end of said first limb being remote from said proximal end and being connected to said distal end of said second limb;

said proximal end of said second limb comprising a pair of oppositely disposed recesses; and wherein said cap being attached to said first limb by means of a spring mechanism for resiliently engaging said oppositely disposed recesses.

16. A method for making decorative jewelry or accessories from pins comprising a first limb, a second limb, and a detachable cap, wherein said detachable cap being removably attached to said first limb at a proximal end of said limb which is further connected at a distal end thereof to said second limb, and wherein a proximal end of said second limb remote from said distal end of said first limb comprising a threaded connector for being received by a threaded receiving means of said cap and being releasably engagable with said cap, comprising the steps of:

removing said cap from said pin;

placing beads or other decorative items onto said first limb; and attaching said cap to said limbs.

17. A method for making decorative jewelry or accessories from pins comprising a first limb, a second limb, and a detachable cap, wherein said detachable cap being removably attached to said first limb at a proximal end of said limb which is further connected at a distal end thereof to said second limb, and wherein a proximal end of said second limb remote from said distal end of said first limb comprising a pair of oppositely disposed recesses and said cap being attached to said proximal end of said second limb by means of a spring mechanism, comprising the steps of:

removing said cap from said pin;

placing beads or other decorative items onto said first limb; and attaching said cap to said limbs.

18. A method for assembling a pin comprising a first limb, a second limb, and a detachable cap wherein said detachable cap being removably attached to said first limb at a proximal ends of said first limb, which is connected at a distal end thereof to a distal end of said second limb, and wherein said distal end of said second limb being releasably engageable with said cap by means of a threaded connector, comprising the steps of:

attaching said cap to said second limb by a threaded receiving means.

* * * * *

US005657519C1

(12) REEXAMINATION CERTIFICATE (4623rd)

United States Patent

Smith

(10) Number: US 5,657,519 C1

(45) Certificate Issued: Aug. 6, 2002

(54) SAFETY PIN WITH DETACHABLE CAP

(75) Inventor: Susan A. Smith, 871 Dana, Valley Stream, NY (US) 11580

(73) Assignee: Susan A. Smith, Valley Stream, NY (US)

Reexamination Request:
No. 90/005,282, Mar. 5, 1999

Reexamination Certificate for:

| | |
|---|---|
| Patent No.: | **5,657,519** |
| Issued: | **Aug. 19, 1997** |
| Appl. No.: | **08/563,373** |
| Filed: | **Nov. 28, 1995** |

(51) Int. Cl.[7] ..... A44B 9/12

(52) U.S. Cl. ..... 24/710.2; 24/706.5; 24/708.7; 24/711.4

(58) Field of Search ..... 24/710.2, 706.5, 24/708.7, 711.4, 706.1, 707.9, 711.5, 709.1, 710, 116 A

(56) References Cited

U.S. PATENT DOCUMENTS

| | | | | |
|---|---|---|---|---|
| 166,481 | A | 8/1875 | Shedlock | |
| 515,214 | A | 2/1894 | Griffin | 63/20 X |
| 558,639 | A | 4/1896 | Davidson | 63/20 X |
| 626,506 | A | 6/1899 | Sleight | 63/20 X |
| 634,567 | A | 10/1899 | Ballou et al. | 63/20 X |
| 663,063 | A | 12/1900 | Clausen | 63/20 X |
| 1,013,482 | A | 1/1912 | Frederick | |
| 1,144,715 | A | 6/1915 | Lane | |
| 1,354,094 | A | 9/1920 | Dolbey | |
| 2,118,639 | A | 5/1938 | Bayardi | 63/20 |
| 3,047,921 | A | 8/1962 | Lorber | |
| 3,323,324 | A | 6/1967 | Bohlinger et al. | 63/20 X |
| 3,893,819 | A | 7/1975 | Schaiewitz | |
| 4,879,882 | A | 11/1989 | Johnson et al. | |
| 5,138,855 | A | 8/1992 | Faris | |

FOREIGN PATENT DOCUMENTS

| | | | | |
|---|---|---|---|---|
| DE | 334534 | | 3/1921 | |
| FR | 0419795 | * | 1/1911 | 24/707.1 |
| FR | 788110 | | 10/1935 | 63/20 |
| FR | 1004081 | | 3/1952 | 63/20 |
| FR | 1068408 | | 6/1954 | 63/20 |
| GB | 5842 | | of 1893 | 63/20 |

* cited by examiner

*Primary Examiner*—Victor Sakran

(57) ABSTRACT

A pin for decorating items comprising a plurality of limbs and a detachable cap. The pin comprises a first limb and a second limb. Each of the limbs comprises a distal end and a proximal end. A distal end of the first limb is attached to a distal end of the second limb. The proximal end of the first limb is removably secured to the cap independently of the second limb, and a proximal end of the second limb is removably secured to the cap independently of the first limb. At such time as the first and second limbs are both detached from the cap, decorative items and accessories may be threaded onto or removed from the first or second limbs. Following the threading of the accessories, both the first and second limbs may be independently reattached to the cap.

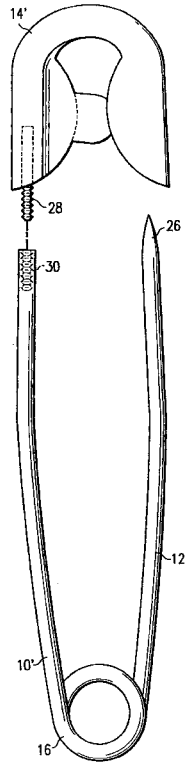

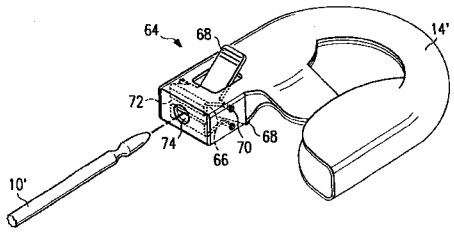

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 2 is confirmed.

Claims 1 and 3–18 are cancelled.

New claims 19–24 are added and determined to be patentable.

*19. A pin comprising:*

*a first limb having a proximal end and a distal end, the proximal end of the first limb comprising a male threaded connector;*

*a second limb having a proximal end and a distal end, the proximal end of the second limb having a point;*

*said distal end of said first limb being remote from said proximal end and being connected to said distal end of said second limb;*

*a resilient spring coil intermediate of the first and second limbs and connecting the distal end of the first limb with the distal end of the second limb; and*

*a detachable cap for independently receiving the proximal ends of the first and second limbs, said cap having a female threaded receiving element for receiving and securing the proximal end of the first limb and a channel for receiving the proximal end of the second limb, wherein said cap extending forward of said proximal end of said second limb for protecting external elements from the point of said second limb.*

*20. The pin of claim 19, wherein said coil spring maintains said second limb biased against the internal channel of said cap upon receiving said second limb.*

*21. The pin of claim 19, wherein upon releasing the proximal end of the second limb from the cap, the resilience of the spring coil urges said second limb in a direction away from said first limb.*

*22. A method for making decorative jewelry from a safety pin comprising the following steps:*

*providing a safety pin, wherein said pin comprising:*

*a first limb comprising a proximal end and a distal end, said proximal end having a male threaded connector;*

*a second limb comprising a proximal end and a distal end said proximal end having a point;*

*a detachable cap being removably attached to said proximal end of said first limb;*

*said cap is adapted to independently receive the proximal ends of the first and second limb, said cap having a female threaded receiving element for receiving and securing the proximal end of the first limb, and a channel placed apart from said female receiving element and being adapted to receive the proximal end of the second limb, wherein said cap extending forward of said proximal end of said second limb for protecting external elements from the point of the second limb;*

*a resilient coil spring intermediate of said first and second limbs for connecting said distal ends of said first and second limbs and holding said first and second limbs in tension;*

*removing said cap from said pin;*

*placing decorative items onto said first limb; and*

*attaching said cap to said limbs.*

*23. The method for making decorative jewelry of claim 22, further comprising opening said pin comprising the following steps:*

*releasing the proximal end of the second limb from said cap, wherein said spring coil holds said second limb in a position away from said first limb; and*

*turning said cap in a counter-clockwise position for releasing the threaded proximal end of the first limb from said cap.*

*24. The method for making decorative jewelry of claim 22, further comprising closing said pin comprising the following steps:*

*turning said cap in a clockwise direction for receiving the threads of the proximal end of the first limb; and*

*pushing the proximal end of the second limb into said channel within said cap, wherein said spring coil holds said second limb in tension against said channel.*

* * * * *